US006199299B1

(12) United States Patent
Prough et al.

(10) Patent No.: US 6,199,299 B1
(45) Date of Patent: Mar. 13, 2001

(54) FEEDING OF COMMINUTED FIBROUS MATERIAL TO A PULPING PROCESS

(75) Inventors: J. Robert Prough, Queensbury, NY (US); Jerry R. Johanson, San Luis Obispo, CA (US)

(73) Assignee: Andritz-Ahlstrom Inc., Glens Falls, NY (US)

( * ) Notice: Subject to any disclaimer, the term of this patent is extended or adjusted under 35 U.S.C. 154(b) by 0 days.

(21) Appl. No.: 09/055,408

(22) Filed: Apr. 6, 1998

(51) Int. Cl.[7] ..... F26B 1/00

(52) U.S. Cl. ..... 34/368; 34/367; 34/384; 34/138; 34/139; 34/141; 34/166; 34/182

(58) Field of Search ..... 34/367, 368, 369, 34/370, 380, 384, 138, 139, 141, 166, 177, 181, 182

(56) References Cited

U.S. PATENT DOCUMENTS

| | | |
|---|---|---|
| 5,476,572 | 12/1995 | Prough . |
| 5,500,083 | 3/1996 | Johanson . |
| 5,617,975 | 4/1997 | Johanson et al. . |
| 5,622,598 | 4/1997 | Prough . |
| 5,628,873 | 5/1997 | Johanson et al. . |
| 5,635,025 | 6/1997 | Bilodeau . |

OTHER PUBLICATIONS

"Use Screw Feeders Effectively", Marinelli et al, *Chemical Engineering Progress*, Dec. 1992, pp. 47–51.
"Feeding", Johanson, *Chemical Engineering/Deskbook Issue*, Oct. 13, 1969, pp. 75–83.

*Primary Examiner*—William Doerrler
*Assistant Examiner*—Malik N. Drake
(74) *Attorney, Agent, or Firm*—Nixon & Vanderhye P.C.

(57) ABSTRACT

In a chisel-type convergence for a chip bin in a wood chip pulping process and system, an improvement in uniformity of discharge of the chips from a chips bin or the like is provided. The bin includes a conventional hollow substantially right circular cylindrical first, upper, body portion, a second, hollow transition, portion connected to the bottom of the first portion, and a third transition portion, below the second portion and above a metering device, such as a metering screw or a star-feeder. The third transition operates less than full of chips, and provides relief from chip compaction. The third transition portion may include stationary or movable baffles, and/or a metering screw may be provided which can pivot downwardly in order to minimize or eliminate the thrusting force against the bin or upper chips to facilitate discharge.

32 Claims, 12 Drawing Sheets

FIG. 7C
FIG. 7D
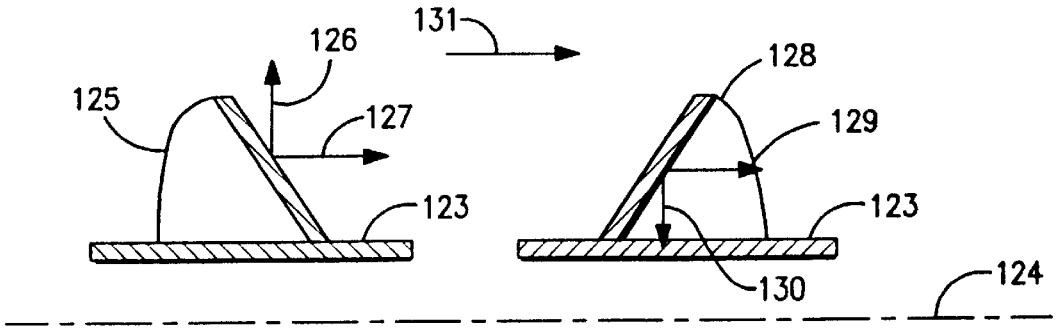
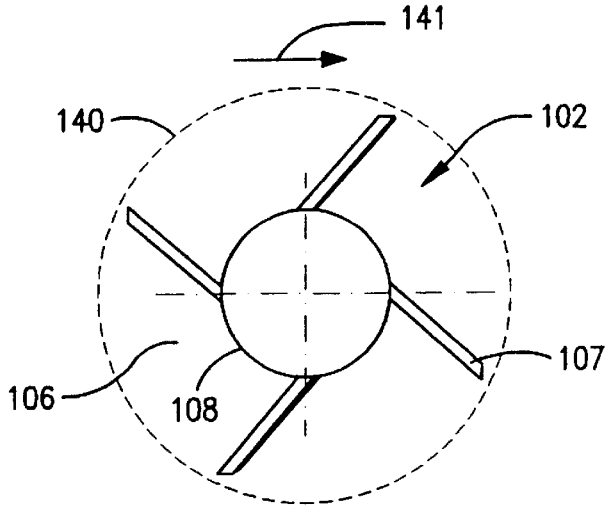
FIG. 10A
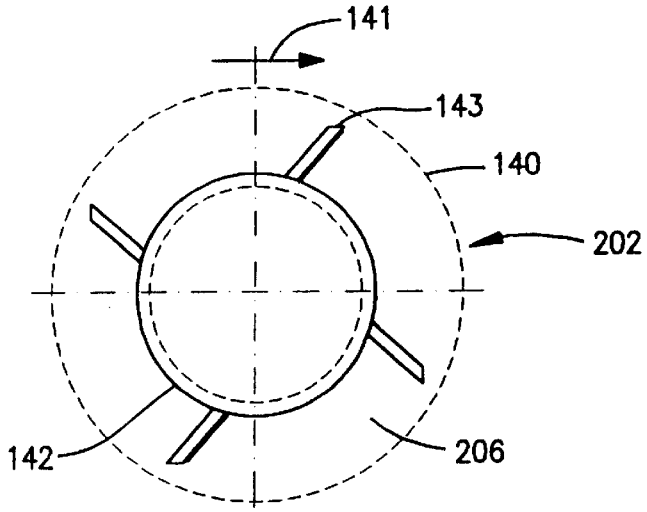
FIG. 10B

FEEDING OF COMMINUTED FIBROUS MATERIAL TO A PULPING PROCESS

BACKGROUND AND SUMMARY OF THE INVENTION

U.S. Pat. Nos. 5,500,083; 5,617,975; and 5,628,873 (the disclosures of which are incorporated by reference herein) disclose assorted methods and devices for storing, treating, and discharging comminuted cellulosic fibrous material prior to treatment in a chemical pulping process. Such devices, typically chip bins, are marketed under the trademark DIAMONDBACK® by Ahistrom Machinery of Glens Falls, N.Y. The DIAMONDBACK® chips bins have been a remarkably successful innovation that has received widespread acceptance throughout the pulping industry. The DIAMONDBACK® bins are characterized by uniform movement and treatment without the need for mechanical agitation or vibration that is characteristic of the prior art bins and of the other offerings in the field.

In addition to the single-convergence DIAMONDBACK® chip bin technology disclosed in these patents, U.S. Pat. No. 5,617,975 also discloses an alternative geometry employing "chisel-type" convergences. In particular FIGS. 2 and 3 of U.S. Pat. No. 5,617,975 disclose a bin discharging arrangement which includes a substantially cylindrical bin having a discharge transition with gradually converging opposite side walls which converge to a substantially rectangular outlet. The substantially rectangular outlet includes a metering screw that transfers the material to a discharge. The chisel-type convergence device has also proven to be effective for uniformly treating and discharging material from the bin while insuring uniform movement of the material through the bin. Vessels having this geometry are marketed under the trademark CHISELBACK™ by Ahistrom Machinery.

Although, the CHISELBACK™ bin has also been proven to be effective for treating and handling wood chips, research has shown that certain improvements can be made to the CHISELBACK™ bin to enhance its performance. For example, due to the uniform movement of material through the upper cylindrical portion and the lower transition portion, it has been found that non-uniform agitation of the material in the outlet below the bin can affect the movement of the material above. Where the DIAMONDBACK® bin is typically not as sensitive to such non-uniformities (since the DIAMONDBACK® bin converges to a generally localized, circular or square-shaped discharge) the CHISELBACK™ bin, having a relatively elongated discharge, is more susceptible to non-uniformities. For example, when the metering screw of a CHISELBACK™ bin transfers material to one side of the bin the horizontal thrust of the screw produces a build up of material on one side of the bin which hampers the movement of material on that side. In addition, the proximity of a screw or other conveyor to the outlet of the bin transition can also hinder the uniform flow of material out of the discharge and thus affect the movement of the material above. These and other deficiencies of the chisel-type bin disclosed in U.S. Pat. No. 5,617,975 are addressed by the present invention In accordance with the invention a method and apparatus are provided such that: the chips are substantially continuously and uniformly withdrawn from the "chisel"; the upward or lateral thrust of the discharge device into the chip column above is minimized, if not eliminated entirely; and the discharge of the metering device to the subsequent device/conduit is substantially uniform and continuous.

Substantially continuous and uniform withdrawal from the transition heretofore was not typically required when treating comminuted cellulosic fibrous material, nor was the reason for desiring such a uniform withdrawal recognized in this art. In applications dealing with the uniform column movement in digesters, it has only been recently recognized how critical it is to establish uniform flow and treatment throughout the height of a vessel transferring comminuted cellulosic fibrous material. It has recently been learned that this is particularly important in the lower portions of a vessel since conditions there can affect the movement throughout the height of the vessel. Vessels in which the treatment in the vessel is highly dependent upon this uniform movement, such as the vessels in which steam is introduced to heat and displace the air, or other gases or liquids are introduced to treat the material, are particularly sensitive to the effects of non-uniform chip column movement.

The prior art vessels have been characterized by non-uniform withdrawal, as evidenced by vibrating discharges in the chip bins and rotating agitators in the chip bins, impregnation vessels and digesters. Except for the DIAMONDBACK® bins, substantially uniform discharge was heretofore unknown.

According to an embodiment of the present invention, the chips are preferably continuously withdrawn so that little or no back-up of chips into the chisel transition occurs and the flow across the outlet of the chisel is continuous and as uniform as possible so that the treatment is as uniform and efficient as possible. For example, this substantially uniformity may be exemplified by a method and apparatus in which the retention time in the vessel does not vary more than +/−5 minutes for any individual volume of chips compared to any other individual volume, preferably +/−4 minutes, or less, for a throughput of at least 30 tons of chips per day (e.g. at least about 50 tons per day).

The minimization of upward thrust, or lateral thrust having an upward component is discussed below. Several ways of perfecting this are disclosed, including a height H of a third transition at least as great as the width of the open bottom of a second transition; an adjustable outlet width; and a "step-in" of the outlet to a width narrower than the transition conduit. These options may be used alone or in combination. For example, the lower transition having a height H may be unnecessary if the step-in or adjustable outlet is sufficient to ensure that little or no upward thrust is imposed on the chip column. However, there are many other ways that this could be perfected, in addition to a multi-star-type metering device and a downward-sloping screw. For example, the screw flights could be re-designed so that they are leaning or canted forward instead of backward (as is conventional). Having the flights leaning forward can impose a load on the chips having a horizontal and downward force component and little or no upward component.

Therefore, in one embodiment of the invention, the mechanism for metering chips from the vessel imposes little or no force on the downflowing chip mass that impedes the movement of material in the chip mass.

In addition, if horizontal or upward forces cannot be eliminated, it is preferred that the force be directed against a generally vertical wall of the transition or a wall that is tapering inward and not against a wall tapering outward. The generally vertical wall or a wall tapering inward is less likely to transfer a thrusting force upward into the chip column A wall that is tapering outward undesirably allows the force to be transferred upward along the taper and into the chip column and thus interferes with the column movement.

The continuous discharge is preferred to prevent the discharge of "slugs" of chips to the downstream conduit or device. There are also various ways of achieving this. One way is to modify a multi-chip meter, or other multi-star-type feeder, design so that the pockets of the feeder are offset, or out of phase, so that as the pockets of one star-type feeder are being filled the pockets of another feeder are emptying. Thus a fairly uniform discharge of the metering device is obtained instead of having a "slug" discharged that would occur if the star-feeders were not off-set, that is, synchronous. In addition, instead of the pockets being oriented parallel to the axis of the shaft, the pockets, or their paddles, may also be angled relative to the axis of rotation. The pockets of one angled rotor may also be off-set, or out of phase, with the pockets of the adjacent rotor.

In addition, in order to improve the uniformity with which chips are discharged from the multi-star feeder device, the star-type feeder may be designed to have shallower pockets, or a larger shaft, and operated at a faster rotational speed. Due to the depth of the pockets of a conventional star-type feeder, for example, a Chip Meter, the speed of rotation of the feeder is relatively slow. This allows sufficient time for the pockets to fill as the pocket rotates passed the inlet of the feeder. As a result, when the conventional feeder is rotated to the outlet, a slug of chips falls out of the slowly moving pocket as the pocket is exposed to the outlet. However, by designing a shallower pocket and rotating the rotor faster (e.g. at least 10% faster than the conventional maximum operating rpm), a more uniform, non-slug-like discharge of chips can be obtained. Furthermore, the pockets of two or more star-type feeder rotors can be mounted out of phase so that a relatively uniform discharge of material is obtained. Again, the pockets may also be oriented so that they are not parallel to the axis of rotation. If necessary, circumferential "mid-feathers", or barriers, may be used to improve the uniformity of the filling of the pockets and prevent "short circuiting" of the material passed the flights of the feeder.

Another similar metering device that can be used to ensure a relatively uniform discharge of chips is one or more screw-type devices that pass the chips from an upper inlet to a lower outlet instead of transferring the material horizontally. Similar to the multi-star feeder discussed above, the screw-type device can be designed with a relatively shallower screw flight height and operated at a higher speed of rotation. For example, the screw according to the invention may have the same profile as the rotors as described above. This metering screw may also extend across the outlets or transitions such that no baffles are necessary. Again, if necessary, circumferential "mid-feathers", or barriers, may be used to improve the uniformity of the filling of the flights and prevent "short circuiting" of the material passed the flights of the screw. Also, to ensure uniform discharge, the screw may contain more than one continuous screw flight, for example, at least two continuous parallel flights may be used.

Also, if the metering device can not itself provide a uniform discharge of material, the device following the metering device can provide the uniform discharge. For example, if the multiple-star-type feeder discussed above comprises or consists of one or more conventional, deep-pocket, slow rotational feeders, these one or more feeders can discharge to a device, for example, a horizontal feed screw, that provides a uniform discharge of material to an outlet.

There are many ways that the discharge device may be designed. However, preferably the present bin for handling comminuted cellulosic fibrous material includes: a mechanism or method for substantially continuously and uniformly withdrawing material from the "chisel"; a mechanism or method for minimizing the upward thrust into the chip column above it; and a mechanism or method for substantially uniformly and continuously discharging the material from the metering device.

One generalized embodiment of the present invention comprises or consists of a "chisel-type" discharge as shown in U.S. Pat. No. 5,617,975 in which the flow of material through the bin is not hindered by the way in which the material is discharged from the bin. For example there may be provided: A bin for handling comminuted cellulosic fibrous material comprising: a hollow substantially right circular cylindrical first, main body portion having a substantially vertical central axis, a top and an open bottom; a top wail closing off the top of the main body portion, and allowing introduction of particulate material into the hollow main body portion mounted thereon; a second hollow transition, portion connected to the bottom of the first body portion having a substantially circular cross-section open top and a substantially rectangular cross-section open bottom and a first width dimension, and a larger cross-sectional area at the top thereof than at the bottom thereof, and opposite non-vertical gradually tapering side walls; at least one metering device mounted below the open bottom of the second transition portion, in a housing; a third, hollow transition, portion located between the second hollow transition portion and the metering device housing and having a height; a discharge operatively connected to the metering device housing; and the at least one metering device being operable to move particulate material from the bottom of the third transition portion to the discharge; and wherein the height of the third hollow transition portion is at least equal to the first width dimension of the open bottom of the second hollow transition portion. In a preferred embodiment of the present invention, the third hollow transition portion has a second width dimension and the second width dimension is greater than the first width dimension.

Preferably one or more baffles is or are provided between the second transition portion and the third transition portion for extending the converging side walls of the second transition portion into the third transition portion, and to provide radial relief from material flowing into the third transition portion. Preferably the one or more baffles is or are adjustable (preferably two adjustable baffles are provided) to adjust the width of the open bottom of the second transition portion to regulate the flow of material from the second transition portion through the third transition portion to the metering device. The baffles may be spaced from each other a different width from one end of the metering device to another, so that the spacing therebetween increases from a point furthest from the discharge to a point adjacent the discharge.

The metering device may comprise a single variable pitch metering screw. Alternatively the metering device may comprise at least one metering screw that is disposed at an angle of at least about two degrees (e.g. about 2–15 degrees), sloping downwardly from the horizontal from a position furthest from the discharge to a position closest to the discharge. Alternatively the metering device may comprise a plurality of star-type metering devices, and baffles may be provided between the star-type metering devices to direct material into the devices. Also steam introduction into the first body portion may be provided as is conventional per se.

According to another aspect of the invention there is provided a method of handling comminuted cellulosic fibrous material utilizing a chisel-type discharge from a comminuted cellulosic fibrous material bin having a first hollow substantially right circular cylindrical body portion, a second hollow transition portion connected to the bottom of the first portion and having a substantially cross-section open top and a substantially rectangular cross-section open bottom and a larger cross-sectional area at the top than at the bottom and opposite non-vertical gradually tapering side walls, and at least one metering device mounted below the open bottom of the second transition portion in a housing. The method comprises the steps of: (a) Feeding comminuted cellulosic fibrous material into the top of the first body portion. (b) Causing the material to flow downwardly through the first portion and into and through the second portion. (c) Causing the material to flow through a third transition portion from the second portion to the metering device so that the flow of material from one side to the other is substantially uniform. And, (d) discharging the material from the bin using the metering device. There also preferably is the further step (e) of adjusting the size of the opening between the second transition portion and the third transition portion to control the flow rate of material. Step (e) may be practiced in part by providing a difference in the width from one end of the metering device to another end of the metering device, the spacing substantially continuously increasing.

The method may also be distinguished by the further step of steaming material in the bin. The method may still further be distinguished by steps (c) and (d) are practiced so that the third transition is not completely full of comminuted cellulosic fibrous material so as to provide compression relief for the material; or, where the second portion has an open bottom with a first width dimension, and wherein the third transition portion has a height, and steps (b) through (d) are practiced so that the height of the third transition portion is at least equal to the first width dimension of the open bottom of the second transition portion.

According to yet another aspect of the present invention a vessel for handling comminuted cellulosic fibrous material is provided comprising the following components: A first hollow top portion. A second hollow transition portion disposed substantially directly below the first portion, the second transition portion having a larger cross-sectional area at a top portion thereof than at an open bottom portion thereof with a first width, and opposite non-vertical gradually tapering side walls. A third hollow transition portion located substantially directly below the second hollow transition portion. At least one adjustable baffle operatively disposed between the second and third transition portions to adjust the effective dimension of the first width. And, a metering device disposed (e.g. substantially directly) below the third transition portion for transporting comminuted cellulosic material from the third transition portion to a discharge. And, the third transition portion, during operation, not being completely full of comminuted cellulosic material so that compression relief is provided. The vessel may also be distinguished by the at least one baffle comprising two adjustable baffles that are spaced from each other a different width from one end of the metering device to another, so that the spacing therebetween increases from a point furthest from the discharge to a point adjacent the discharge.

According to another aspect of the invention there is provided a vessel assembly for handling comminuted cellulosic fibrous material comprising: A substantially hollow chisel-type vessel including a substantially cylindrical main body portion with opposite side walls gradually converging to a substantially rectangular outlet. A discharge device below the outlet. And, means for substantially continuously and uniformly withdrawing material from the outlet with minimal or no lateral or upward thrust on the material above the outlet, and for substantially uniformly and continuously discharging the material from the metering device.

According to another aspect of the invention there is provided a method of treating comminuted cellulosic fibrous material using a vessel having a hollow main body and a chisel-shaped discharge to a substantially rectangular bottom outlet, and a discharge device below the outlet, the method comprising the steps of: (a) Feeding material into the top of the vessel to flow downwardly toward the bottom. (b) Substantially continuously and uniformly withdrawing material from the outlet. And, (c) operating the discharge device so that there is substantially no upward thrust on the material above the outlet as a result of the discharge device and so that the discharge of material from the metering device is substantially uniform and continuous. Steps (a)–(c) may be practiced so that the residence time of a volume of material in the vessel does not differ, in a twenty-four hour period, from the residence time of any other volume by more than about four minutes.

According to another aspect of the invention there is provided a method of treating comminuted cellulosic fibrous material using a vessel having a hollow main body and a chisel-shaped discharge to a substantially rectangular bottom outlet, and a discharge device below the outlet, the method comprising the steps of: (a) Feeding material into the top of the vessel to flow downwardly toward the bottom. And, (b) substantially continuously and uniformly withdrawing material from the outlet and, discharging the material from the discharge device, so that the residence time of a volume of material in the vessel does not differ, in a twenty-four hour period, from the residence time of any other volume by more than five minutes.

It is the primary object of the present invention to provide an improved chisel-type bin or other vessel for handling comminuted cellulosic fibrous material, such as wood chips, a method of handling chips, with maximum uniformity. This and other objects of the invention will become clear from an inspection of the detailed description of the invention and the appended claims.

BRIEF DESCRIPTION OF THE DRAWINGS

FIGS. 7C and 7D are detail cross-sectional views of a portion of two embodiments of the metering screw of FIGS. 7A and 7B;

FIGS. 10A–10D are schematic end views of four different embodiments of rotors that may be used in place of the rotor of FIG. 8B.

DETAILED DESCRIPTION OF THE DRAWINGS

Figure 1:
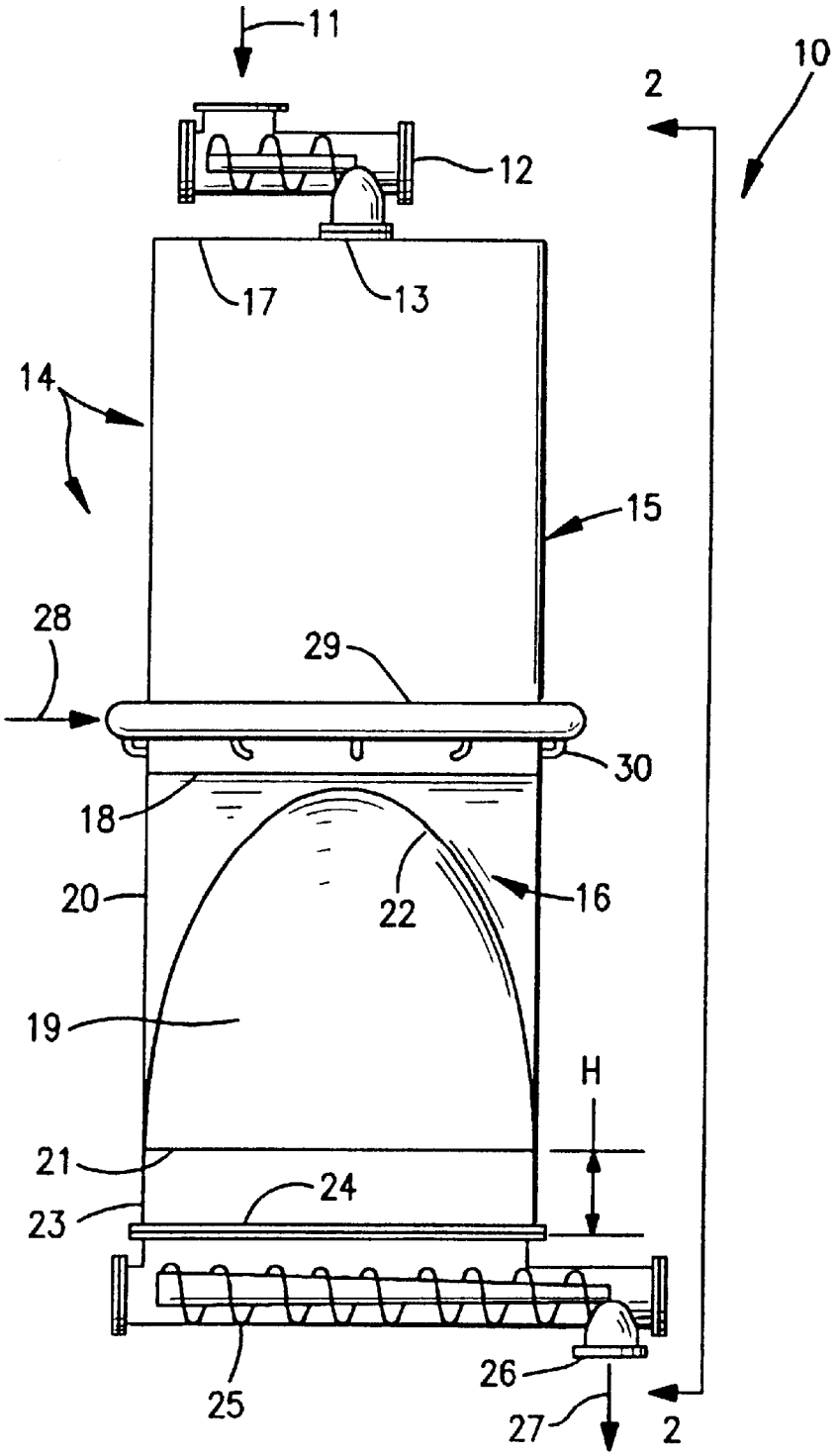
FIG. 1 is a side elevational view, but showing the internal metering screw, of a chisel-type discharge bin for handling comminuted cellulosic fibrous material according to the invention.
Figure 2:
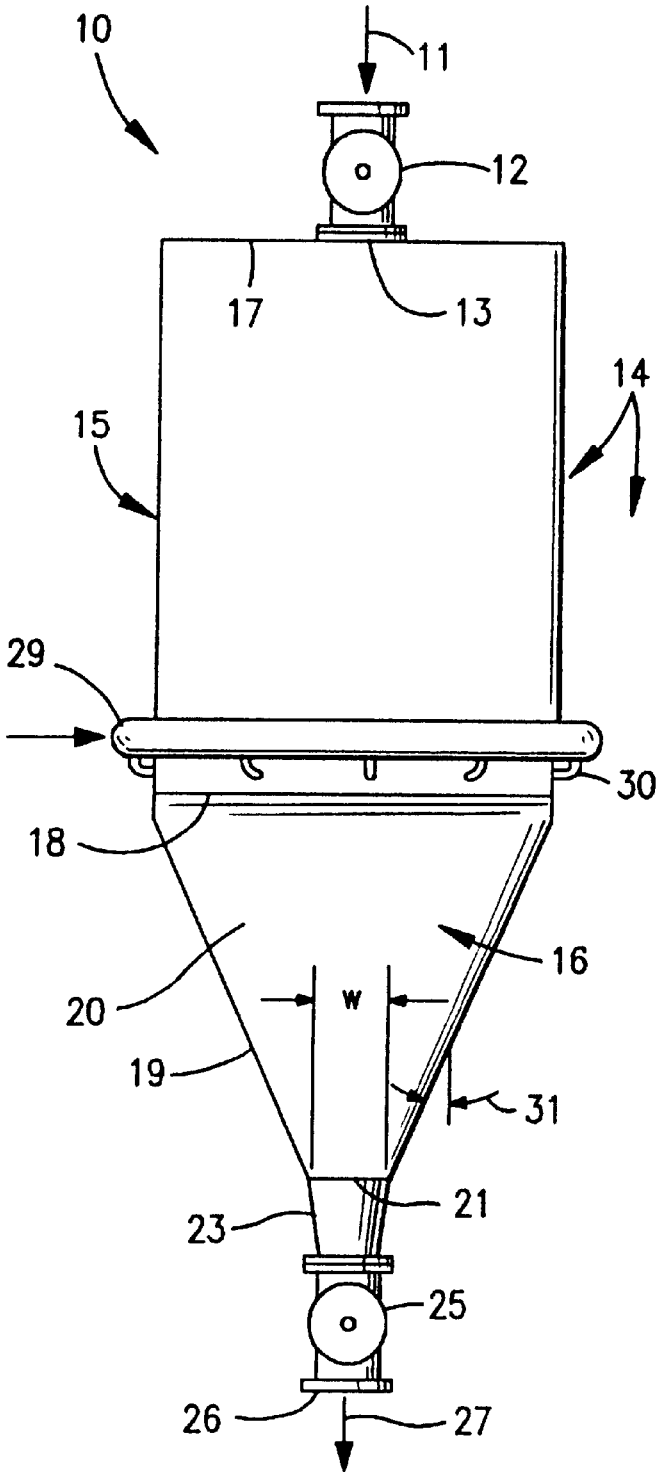
FIG. 2 is a front view of the bin of FIG. 1, looking in along arrows 2—2 of FIG. 1.

FIGS. 1 and 2 illustrate one embodiment of a system 10 for handling comminuted cellulosic fibrous material according to the present invention, for example, for feeding to a chemical pulping digester, either one or more continuous digesters, or one or more batch digesters. Though the term "wood chips" or simply "chips" is used in this discussion it is to be understood that any form of comminuted cellulosic fibrous material may be handled or treated using the system 10.

Wood chips 11 are introduced to the system 10 by the conventional isolation device 12. Though a horizontal screw feeder is shown as the isolation device 12 in FIG. 1, any form of isolation device which helps to isolate the treatment from the atmosphere can be used (for example, a conventional star-type isolation device such as a rotary Air Lock sold by Ahistrom Machinery). One preferred isolation device 12 is a horizontal screw-type isolation device having a preloaded gate at its outlet as disclosed in pending U.S. patent application 08/713,431 filed on Sep. 13, 1996. The isolation device 12 discharges the chips via an outlet 13 to the vessel 14. It is preferred that the outlet 13 provide some mechanisms for directing the flow of chips to the center of vessel 14 to minimize non-uniform distribution of the material and promote uniform vertical loading on the material which improves the treatment, for example, the steaming. One preferred mechanism for introducing chips is to use the synchronized chip gates disclosed in published PCT application PCT/US95/12640. Another preferred mechanism for introducing chips is by means of using "long pointed chip gates", as will be described with respect to FIGS. 11 and 12.

Vessel 14 may comprise or consist of a first, upper cylindrical portion 15 and a second, lower transition portion 16. The upper transition portion 15 is typically circular in cross-section and typically at least 10 feet in diameter. The upper portion 15 typically includes a top wall 17 and an open bottom 18. Transition portion 16 preferably includes opposite gradually-tapering side walls 19, and generally vertical, opposite curved side walls 20, and an open bottom 21. The tapering side walls 19 typically make an angle 31 with the vertical of between about 15 and 35 degrees, preferably between about 20 and 30 degrees. The curved walls 20 generally conform to the circular outlet 18 of the upper portion 15, and the tapering side walls 19, so that the interface 22 between walls 19, 20 forms a somewhat parabolic or triangular shape.

The chips handled by system 10 may be treated with any appropriate treatment fluid, for example, with a liquid, such as water; or cooking liquor, such as kraft white, green or black liquor; or with steam. The treatment liquor may include strength or yield enhancing additives, such as polysulfide or anthraquinone or their derivatives or equivalents. The treatment in vessel 14 may also include or consist essentially of a treatment with a gas, such as treatment with hydrogen sulfide [$H_2S$] gas. The preferred treatment performed in vessel 14 is, however, steaming. High or low pressure steam can be introduced to any part of the system 10 to treat the chips, but steam in line 28 is preferably introduced to cylindrical section 15 (e.g. just above the bottom 18 thereof) by one or more conventional per se annular header pipes 29 and one or more conventional per se evenly spaced nozzles 30.

Unlike the assembly disclosed in U.S. Pat. No. 5,617,975, the assembly 10 embodiment shown in FIGS. 1 and 2 includes a third, open, transition portion 23 below the second transition 16. The open transition 23 has an open substantially rectangular top generally conforming to the substantially open bottom 21 of second transition 16, and an open substantially rectangular bottom 24. The open bottom 24 conforms generally to the inlet of a metering device 25. Though a conventional horizontal screw-type metering device is shown as the device 25, any type of suitable or conventional metering device may be used, such as the multiple star-type metering device described below. In addition, though a single screw 25' transferring material to an off-set discharge is shown as the device 25, it may be preferable to use two screws, for example, on a single shaft, which directs material to a discharge located along the centerline of vessel 14 as shown in U.S. Pat. No. 5,617,975. (Such an arrangement can minimize the horizontal loading on the discharge that can effect the uniform flow of material.)

The treated chips, line 27 are discharged from the outlet 26 of the metering device 25 and forwarded on to further treatment. One preferred treatment is slurrying with cooking liquor and pressurization with a slurry pump as shown in U.S. Pat. Nos. 5,476,572; 5,622,598; and 5,635,025 and marketed under the trademark LO-LEVEL® Feed System by Ahistrom Machinery.

The transition 23 acts to dampen or eliminate the effect of the rotation of the metering device 25 on the flow and distribution of chips above the open bottom 21 of the second transition section 16. The open bottom 21, since it provides substantially the minimum flow area of section 16, acts to limit or to "throttle" the flow of chips out of the section 16 into the transition 23. This throttling effect causes the transition 23 to operate so that it is not completely full of chips [e.g. 50–95% full, e.g. 70–80% full]. Thus, any agitation or thrusting force created by the metering device 25, such as by screw 25', is mitigated or not transmitted at all to the chip mass present above the open bottom 21. By minimizing or eliminating these forces on the chips the flow of chips through transitions 15 and 16 can be more uniform and unhindered by the action of the metering device 25.

As seen in FIGS. 1 and 2, the open bottom 21 of the second portion 16 of the bin 14 has a first width W (FIG. 2), while the third transition portion 23 has a height H (FIG. 1). In order to provide the desired compression relief of the chips in the column within the bin 14, the eight H is greater than the width W. The amount that the height H is greater than the width W will be dependent upon the size of the bin 14, he particular material treated and handled, or the like, but preferably is about 5%–50% greater.

Though the cylindrical portion 15 of FIGS. 1 and 2 is shown having a uniform circular cross-section, it is to be understood that any substantially right cylindrical geometry may be used. One preferred alternative to the uniform diameter shown is for cylindrical portion 15 to have gradually tapering walls, that is to have a frusto-conical shape. In particular, portion 15 preferably has a geometry having an angle of convergence less than the mass flow angle of the material being handled. The mass flow angle of a particulate material is that angle of convergence at which the material is prone to hang-up or bridge over and thus interfere with the uniform flow of the material. For wood chips the mass flow angle is approximately 10–15°. Therefore, in one embodiment of the invention, the cylindrical portion 15 of vessel 14 has substantially uniform convergence at an angle of less than 15° with the vertical, preferably less than about 10°. This conical shape permits the vessel 14 to hold more material for a given height than a vessel having a uniform diameter, as shown.

The cylindrical portion 15 may also include one or more conical inserts to help reduce the vertical column forces on the material below as disclosed in U.S. Pat. No. 5,454,490.

Figure 3:
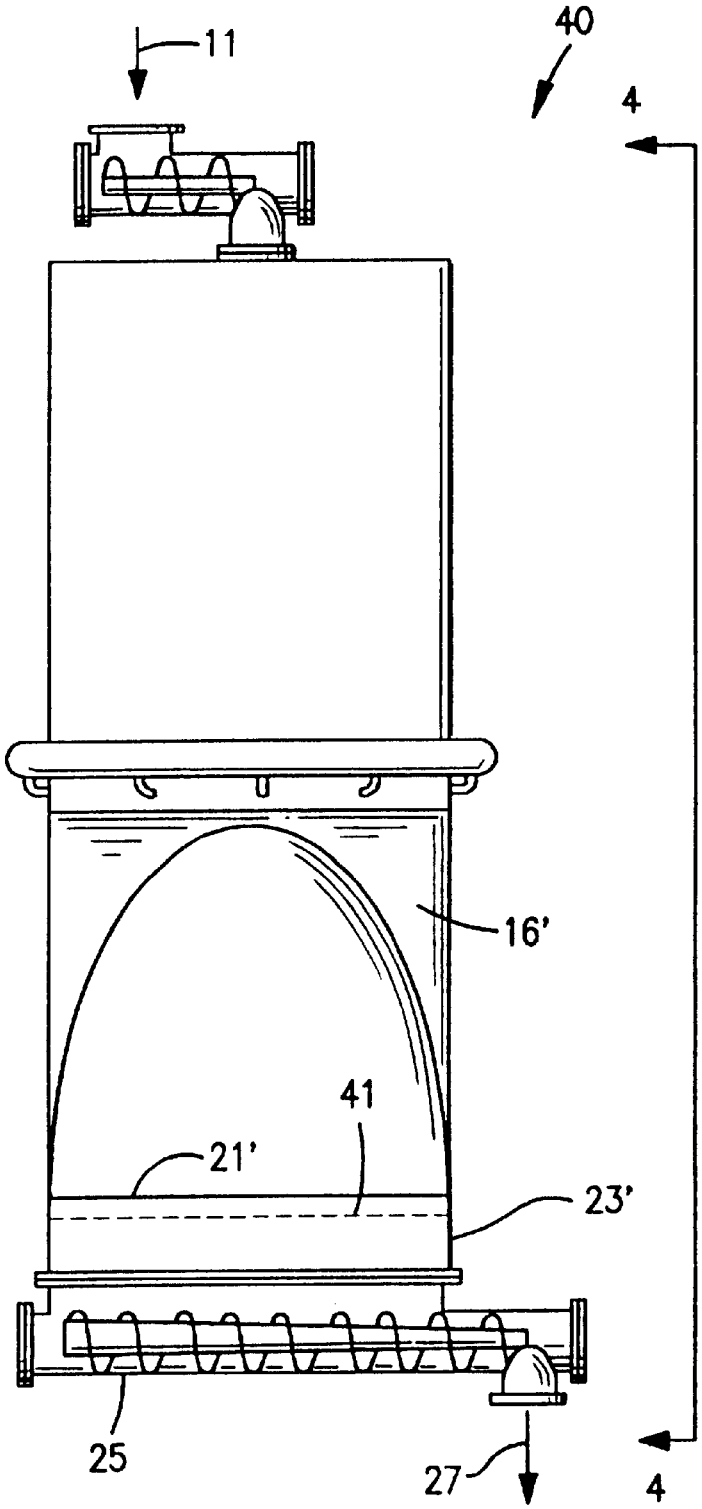
FIG. 3 is a view like FIG. 1 only of another embodiment according to the invention.
Figure 4:
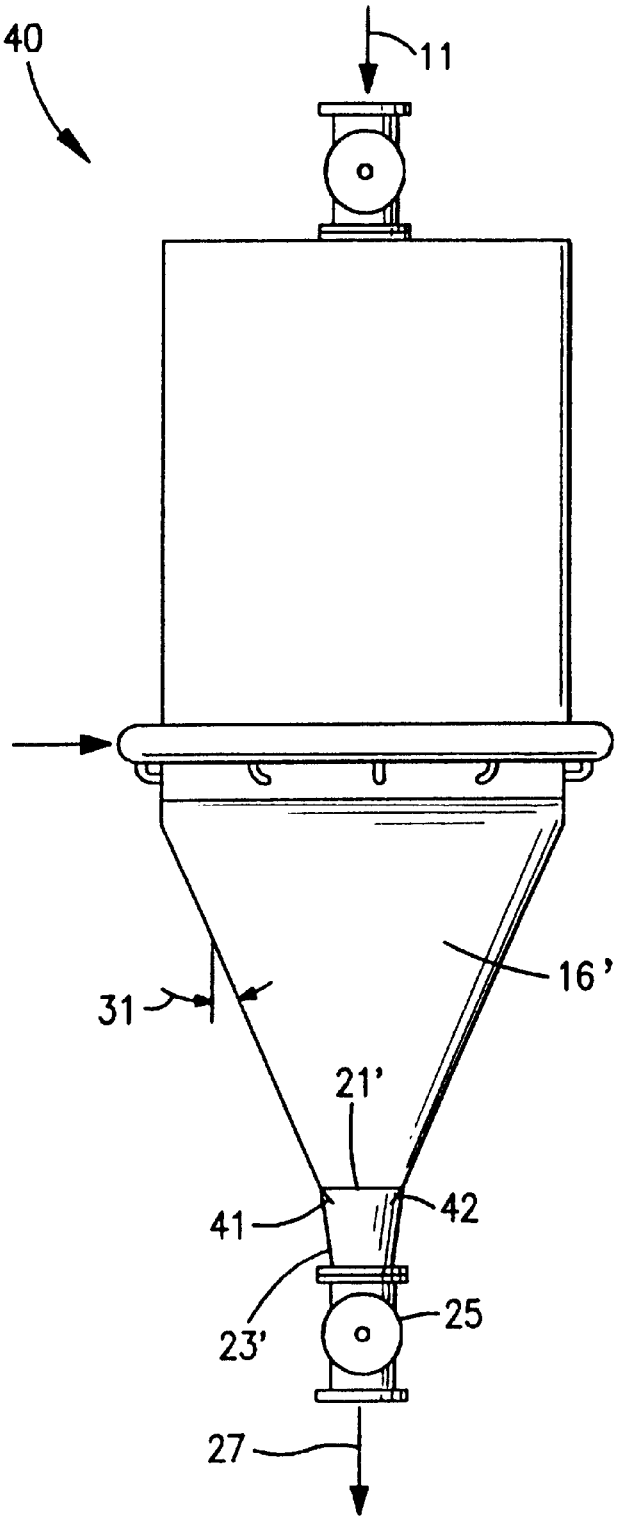
FIG. 4 is a front view of the embodiment of FIG. 3 looking in along arrows 4—4 thereof, but showing the internal baffles used in this embodiment.

FIGS. 3 and 4 illustrate another embodiment of the invention. FIGS. 3 and 4 display a system 40 which is similar to the system 10 shown in FIGS. 1 and 2. The structures shown in FIGS. 3 and 4 are essentially identical to those shown in FIGS. 1 and 2, except for the open bottom 21' of lower section 16'. The open bottom 21' shown in FIGS. 3 and 4 includes one or more baffles 41 and 42 which extend down into hollow third transition 23'. The baffles 41 and 42 act to extend the converging side walls of second transition 16' into the third transition 23'. This extension further increases the throttling effect of the open bottom 21', as discussed above, but also introduces a radial relief of the compacted chip column below the baffles 41 and 42 in transition 23'. This relief further promotes the free flow of material through transition 16' to the metering device 25. The baffles 41, 42 also further minimize the potential for transmitting any side or vertical forces from the metering device 25 to the uniformly flowing chip column above. Instead of using baffles 41, 42, the width of the transition 23' may be made wider than the open bottom 21' to effect a similar chip compression relief.

Figure 5:
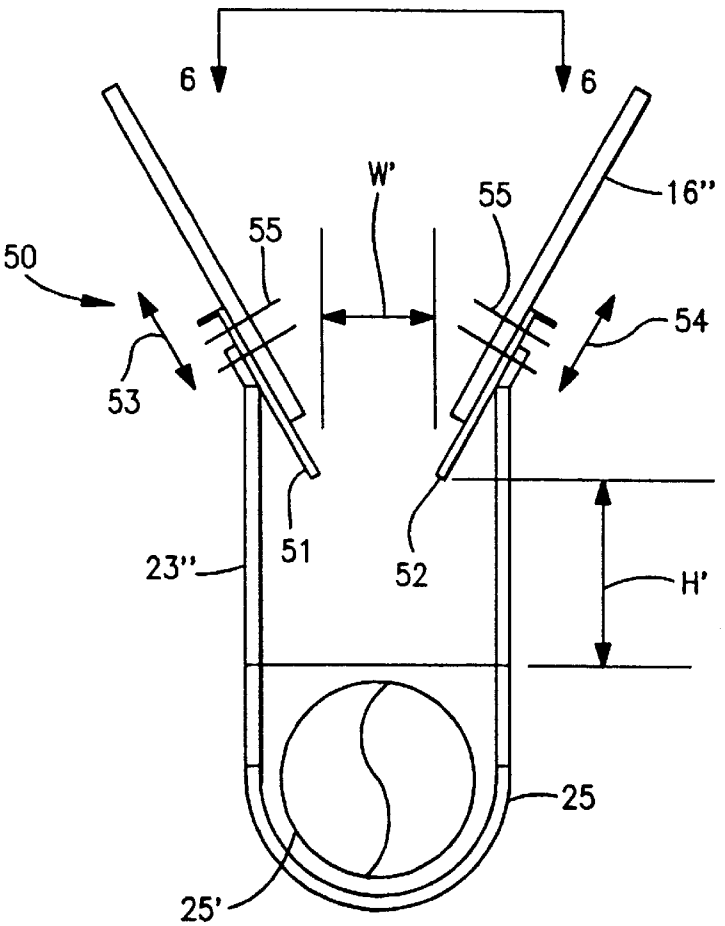
FIG. 5 is a detailed view of another embodiment having a revised form of the baffles of the embodiment of FIGS. 3 and 4.

FIG. 5 illustrates one preferred configuration of the open bottom 50 of transitions 16, 16' of FIGS. 1 through 4. Specifically, FIG. 5 illustrates a detailed view of an open bottom 50 similar to the open bottom 21' of transition 16' of FIG. 4 in which the baffles (41 and 42 in FIG. 4) are designed to be adjustable. The one or more adjustable baffles 51, 52 shown in FIG. 5 are movable in the direction of double arrows 53, 54. The baffles 51, 52 are adjustably mounted to the transition 16' and the transition 23" by any appropriate arrangement, for example, by one or more threaded fasteners schematically represented by lines 55, slidable in elongated openings in the baffles 51, 52 when the fasteners are loosened. By adjusting the location of baffles 51, 52 the width W' of the open bottom of transition 16" can be varied to regulate the flow of material from the transition 16' through transition 23" to the metering device 25.

The metering device typically has a screw-type conveyor 25' driven by an electric motor (not shown). The location of the adjustable baffles 51, 52 also determines the height H' of the open bottom of transition 16' above the metering device 25 to minimize any adverse effect of the metering device 25 upon the flow of material in the bin 15, 16, 16' above. Also, the baffles 51, 52 provide for some compaction relief as the material passes through the throat of the baffles 51, 52, and then expands into the second, larger, width WW of the transition 23".

Figure 6:
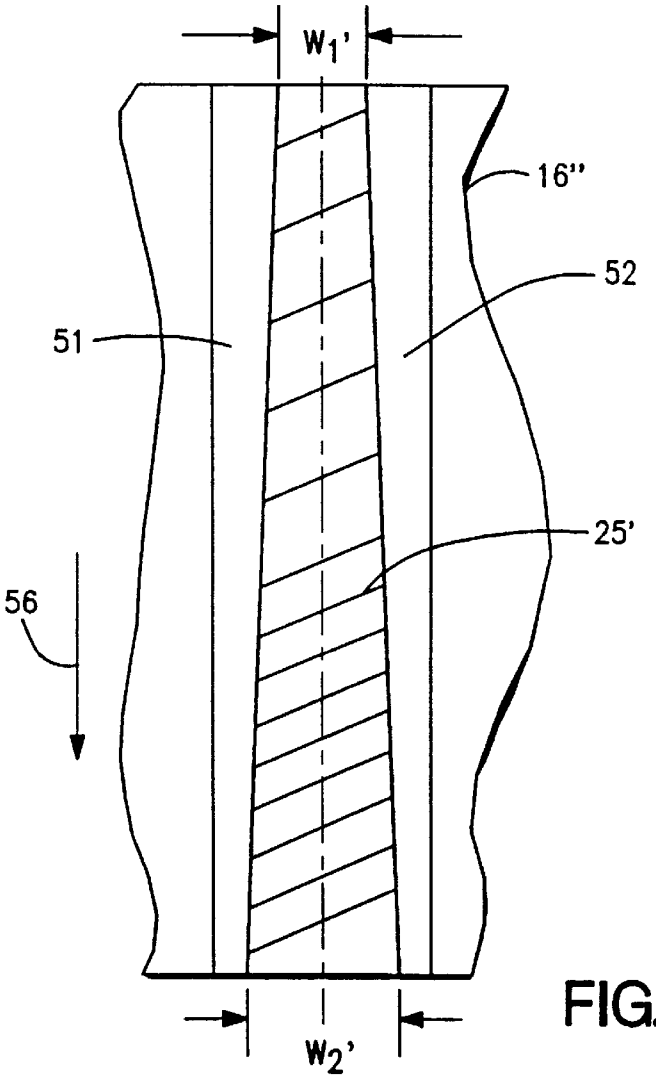
FIG. 6 is a top view of the detail of FIG. 5 looking in along arrows 6—6 thereof.

In order to ensure a uniform removal of material from the metering device 25, the metering screw 25' is typically a conventional variable-pitch screw. This variable-pitch screw 25' preferably has a shaft having an outer diameter that varies along its length to ensure a uniform flow of material out the discharge 26 (of FIG. 1). In a preferred embodiment of the invention shown in FIG. 5, the baffles 51,52 are so constructed that the width W' can vary along the length of the open outlet 50. This is shown in FIG. 6, which is a schematic top view along lines 6—6 of FIG. 5. As seen in FIG. 6, the locations of baffles 51,52 are adjustable so that the width W' can vary from a width $W'_1$ at the end 34 of the metering screw furthest from the discharge 26 in FIG. 1, to a larger width $W'_2$ at the end nearest the discharge 26. The material is transferred in the direction of arrow 56. The widths $W'_1$, $W'_2$ will vary depending upon the type of material, the rate of flow of the material, and the geometry of the metering device 25, for example, the screw 25' geometry, among other things. By increasing the width $W'_2$ of the open bottom 50 of section 16,16' nearest the discharge 26 (FIG. 1) and decreasing the width $W'_1$, adjacent end 34 (FIG. 1), the thrusting force against the vessel 14 and the material above can be minimized or eliminated.

Figure 7A:
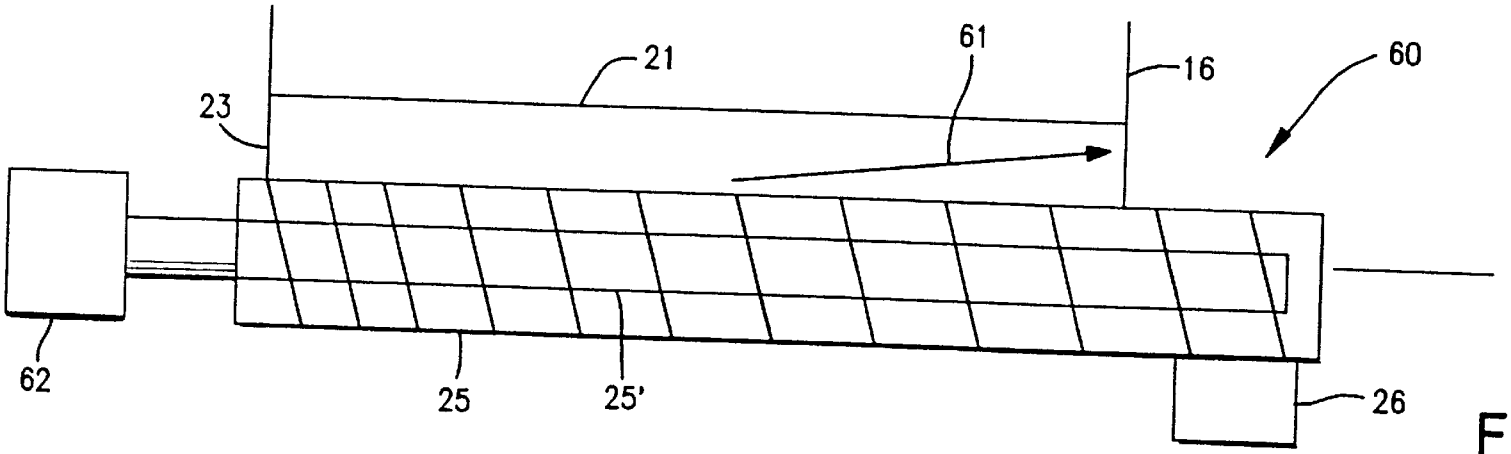
FIGS. 7A and 7B are side schematic views showing the cooperation between the metering device and other components according to other embodiments of the present invention.
Figure 7B:
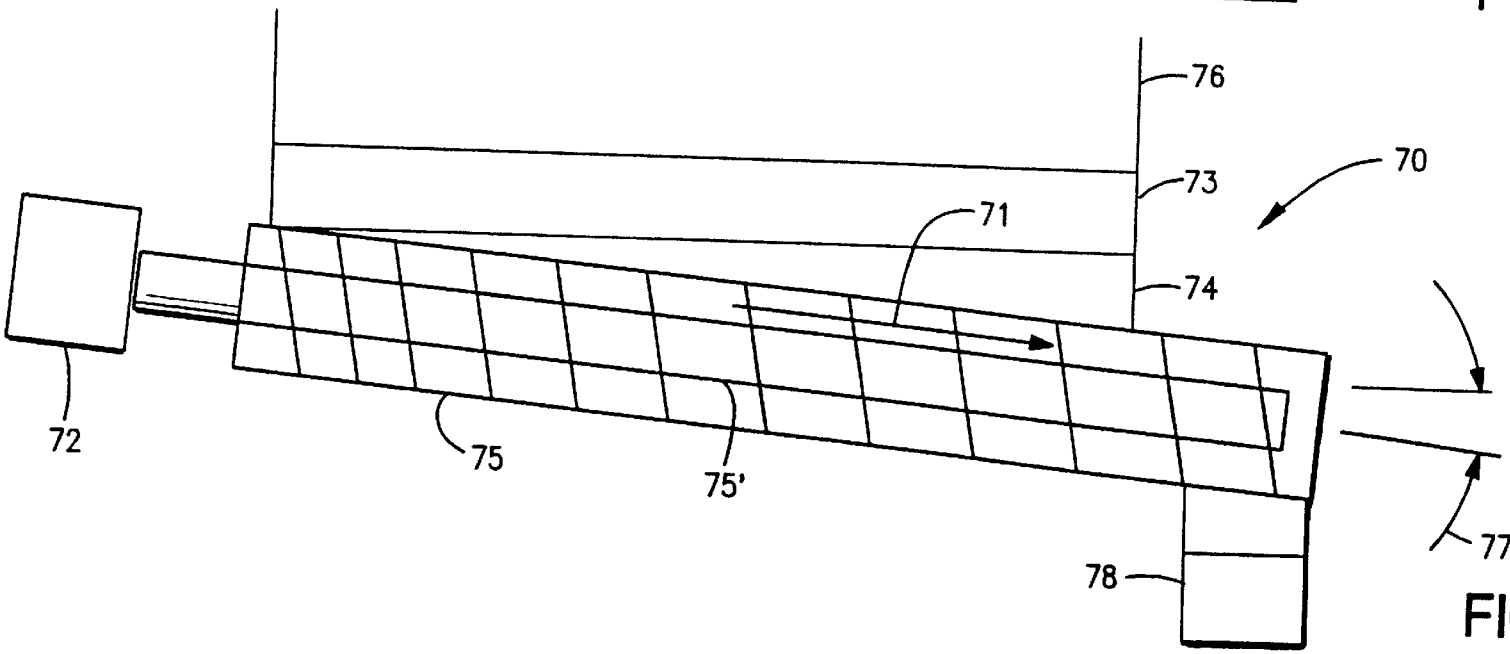

Another way of reducing the thrusting force of a screw-type discharge to promote uniform movement of the material is shown in FIGS. 7A and 7B. FIG. 7A shows a detail 60 of the transitions 16 and 23, open bottom 21, screw conveyor 25, screw 25', and discharge 26 as shown in FIG. 1. FIG. 7A also shows the conventional drive motor 62 which powers the screw 25'. Also shown is the force vector 61 that is generated by the conventional discharge of material by way of screw 25'. Since the material adjacent the discharge 26 typically accumulates at the end of the screw 25', the rotation of screw 25' produces a thrusting force 61 upon the transition 23 and the material above which hinders the flow of material. FIG. 7B illustrates another embodiment of the invention which helps to alleviate this thrusting force and promote more uniform flow.

FIG. 7B illustrates a discharge detail 70 similar to the discharge 60 shown in FIG. 7A. However, as shown in FIG. 7B, the screw conveyor 75, screw 75', and drive motor 72 have been rotated such that the axis of the conveyor 75 makes an angle 77 with the horizontal (e.g. between about 2–15 degrees). By rotating the conveyor 75 as to the position shown in FIG. 7A, the resulting thrusting force 71 is directed along the axis of the screw and not against the transitions 73,74 such that there is little or no hindrance of flow out of transition 76. The discharge 78 has also been moved to accommodate the change in orientation of the screw 75'. The variation in the screw orientation may be fixed or variable so that different operating conditions can be accommodated by varying the angle of orientation 77 (e.g. between about 0–15 degrees).

FIGS. 7C and 7D illustrate the difference between the orientation of the screw flights of conventional screw conveyor 25' of FIG. 7A and the preferred configuration of the screw flights according to the invention. FIG. 7C shows a cross sectional view of a section of one screw flight 125 as typically mounted to hollow shaft 123, the shaft having centerline 124. In conventional screws typically used to convey wood chips, the screw flight 125 is oriented such that it leans away from the direction of transfer of the screw, shown by arrow 131. So oriented, the flight 125, and similar flights of shaft 123, impose both a horizontal force component in the direction of transfer 131, shown by arrow 127, and a vertical force component perpendicular to the direction of transfer 131, shown by arrow 126. This perpendicular upward force 126, in conjunction with the horizontal force 127, imposes an upward thrust upon the chip mass above and thus can interfere with the downward flow of chips out of the vessel above.

FIG. 7D shows a similar view of a preferred orientation of a screw flight 128. Flight 128 leans in the direction of transfer 131 such that horizontal force component 129 and vertical force component 130 are imposed upon the chips being transferred. Unlike the flight of FIG. 7C, the vertical force 130 imposed by the screw is downward not upward. This downward force does not hinder the movement of chips above the screw 60 or 70, but tends to aid in the removal of chips from the vessel 10.

Figure 8A:
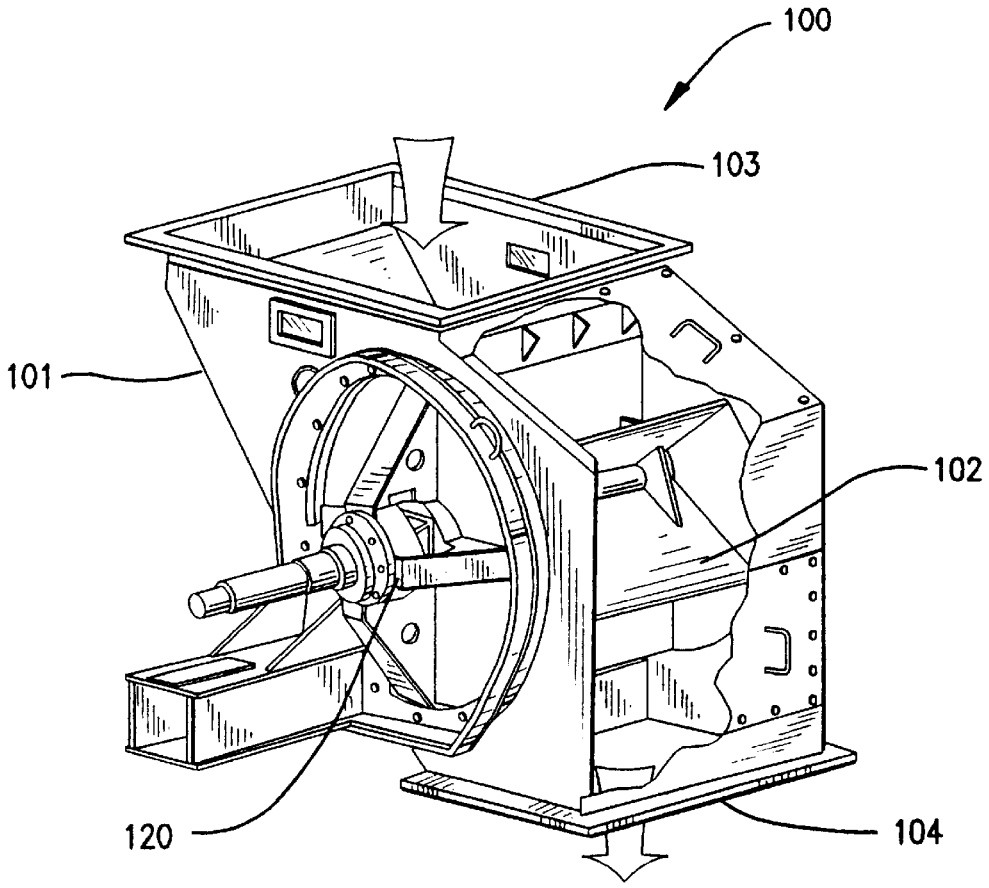
FIG. 8A PRIOR ART
FIG. 8A is an isometric view of a conventional chip meter that may be used in the practice of the invention.

FIG. 8A is an isometric view of a typical prior art Chip Meter 100, as sold by Ahlstrom Machinery. The Chip Meter 100 includes a housing 101 and a pocketed rotor 102. A portion of the housing 101 is partially removed to reveal the location of the rotor 102. The housing includes an inlet 103 for chips and an outlet 104. The rotor 102 as removed from the housing 101 is shown for clarity in FIG. 8B. The rotor typically includes a drive journal 105 to which a source of motive force is attached, for example, a shaft-mounted gear reducer, and two or more pockets 106 for accepting and transporting material introduced to inlet 103 to outlet 104. The rotor pockets 106 are typically defined by radial plates 107 fixed to a central hub 108. The plates 107 may be mounted to hub 108 so that they are direct radially to the hub or they may be oriented at any oblique angle. The plates 107 are preferably oriented leaning into the direction of rotation. The rotor 102 shown in FIG. 8B has 6 radial plates 107; however, the rotor 102 may include any appropriate number of plates, for example, 2 or greater, typically, 4 to 6 plates. The rotor 102 also typically includes re-inforcing plates 109 for stiffening the radial plates 107 against undesirable deflection or breakage. The housing 101 (see FIG. 8A) typically includes two bearing housings 120 for supporting the rotation of the rotor 102. As the pockets 106 are rotated, the radial plate elements 107 propel the material tangentially within the housing. A metering device comprising or consisting of similar multiple star-type feeders 100 having one or more rotors 102 individually mounted and driven or mounted and driven by a common shaft is shown in FIGS. 9A through 9C.

Figure 9A:
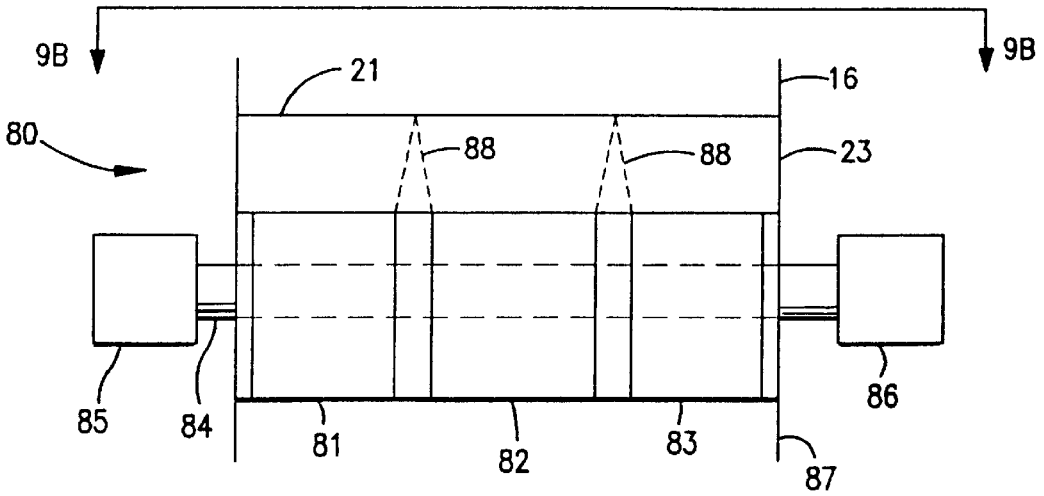
FIG. 9A is a schematic side view of another metering device that may be used in place of the metering device in the FIG. 1 embodiment.

FIG. 9A schematically illustrates another metering arrangement 80 that can be used in place of the screw 25' of FIG. 1. In FIG. 9A, the metering screw 25' of FIG. 1 is replaced by two or more conventional star-type metering devices, 81, 82, and 83, for example, two or more Chip Meters sold by Ahistrom Machinery (and as shown at 100 in FIG. 8A). Preferably these star-type metering devices 81–83 are driven by a common shaft 84, which is driven by a common conventional variable electric motor and/or gear reducer 85 supported by bearing 86. The star-type metering devices 81–83 are typically located below the open bottom 21 of open transition 16 and are preferably located below the open bottom of transition 23. The transition 23 may include one or more baffles 88 for directing the flow of material into one of the metering devices 81–83 and preventing the build-up of material in the inlets of the devices 81–83.

Figure 9B:
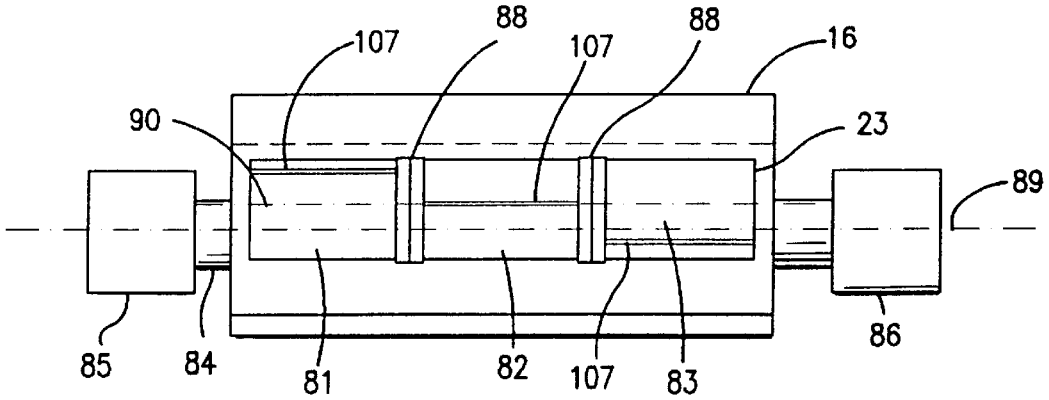
FIG. 9B is a top view of the metering device of FIG. 9A.

FIG. 9B shows a top view of FIG. 9A taken from view 9B—9B of FIG. 9A. FIG. 9B includes the three star-type feeders 81, 82 and 83 driven by a common shaft 84. The feeders 81–83 are fed by means of tapering transition 16 and lower cylindrical transition 23. The shaft 84 is driven motor/reducer 85 and mounted for rotation on bearing 86. The centerline of shaft 84 is identified as dashed line 90. Note that due to the mode of operation of meters 81–83, the centerline of the shaft 90 is offset the centerline 90 of the discharge housing 16. Also shown in FIG. 9B are the 88 which direct the flow to the inlets of meters 81–83.

Figure 8B:
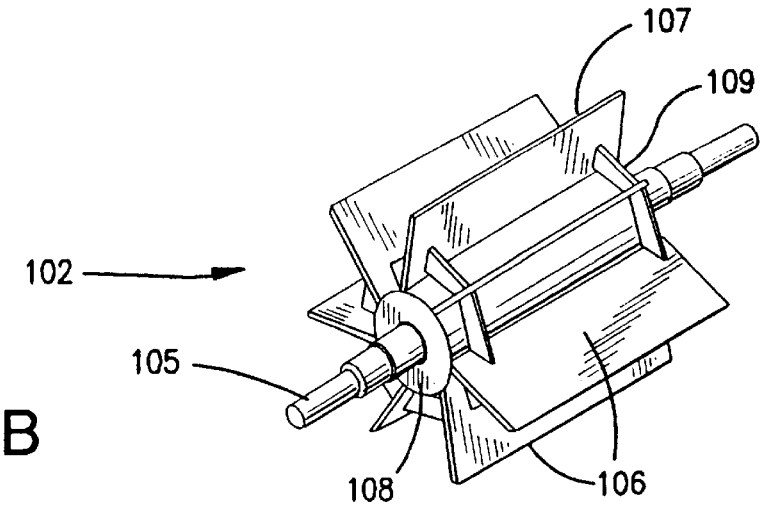
FIG. 8B is an isometric view of the rotor of the chip meter of FIG. 8A.
Figure 9C:
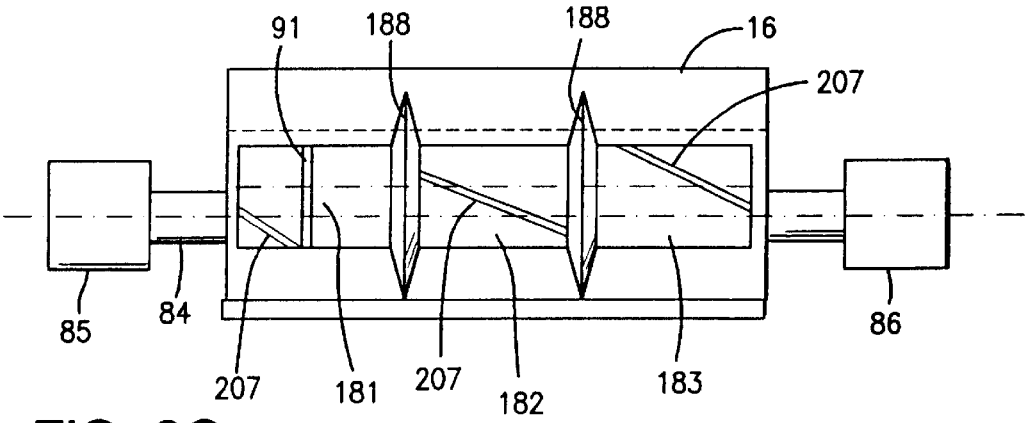
FIG. 9C is a view like that of FIG. 9B only of another embodiment of a metering device.

FIG. 9B also illustrates a typical orientation outer edge of the two or more radial rotor plates 107 (see FIG. 8B). The pockets of the three rotors shown in FIG. 9B are shown "off-set" or "out of phase" such that the filling and emptying of the pockets will provide a relatively continuous discharge of material to the outlet. These pockets may also be oriented in the same position so that the edges of two or more plates 107 shown in FIG. 9B will be collinear.

FIG. 9C shows an arrangement similar to FIG. 9B. Unlike the system shown in FIG. 9B, the meters 181, 182, and 183, which are similar in design and operation to meters 81–83, have rotors with radial plates 207 which are not parallel to the axis of the shaft 84. These rotors may be oriented at any appropriate angle. Meter 181 of FIG. 9C also includes a typical "mid-feather", or circumferential barrier, 91 that may also be used for meters 182 and 183, which helps to maintain a full pocket during the rotation of the rotors. Also, FIG. 9C does not include a lower transition section 23 as in FIG. 9B. The tapered transition 16 of FIG. 9C is mounted directly to the inlets of the meters 181–183. Accordingly baffles 188 are different from baffles 88 since they extend into and conform with the tapered sides of transition 16.

Figure 10C:
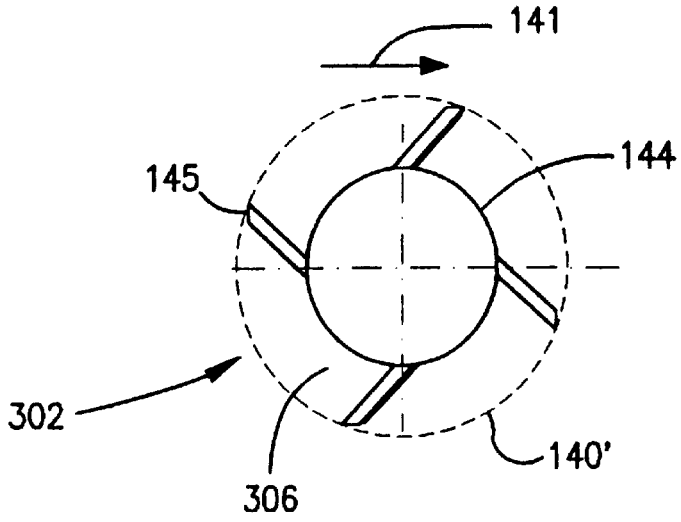

FIGS. 10A through 10D illustrate side views of various rotors, similar to rotor 102 of FIG. 8B, that can be used in the invention of FIGS. 9A, 9B and 9C. FIG. 10A illustrates a conventional rotor 102 having four rotor plates 107, though 2 or more plates may be used, mounted by conventional means to hub 108. The plates 107 and hub 108 define rotor pockets 106. For clarity the support plates 109 of FIG. 8B are omitted from these figures. The rotor turns in the direction of arrow 141 in a housing having an internal diameter shown by dotted line 140. In conventional Chip Meter applications the rotor 102 would turn at between 10 to 15 rpm; however for an application using three of the same rotors, the speed would typically reduced to about a third, or to less than 5 rpm.

Figure 10D:
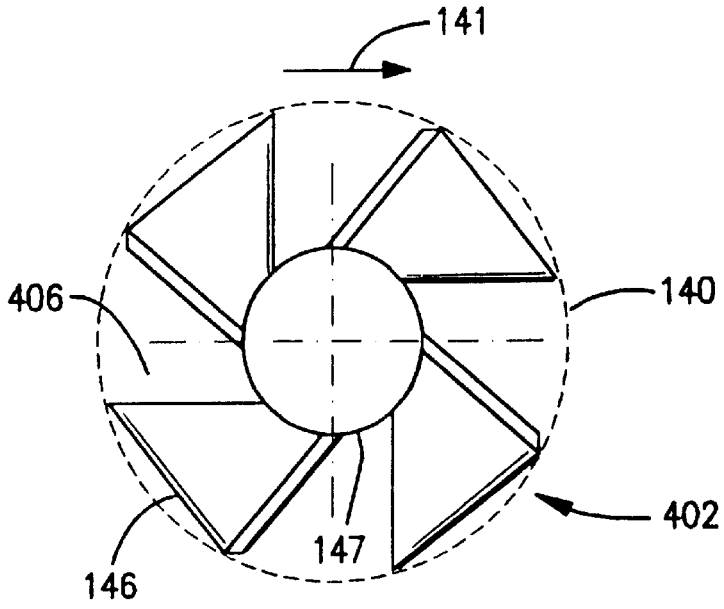

FIGS. 10B, 10C and 10D illustrate modified rotors that can be used in the present invention. FIG. 10B illustrates a rotor 202 similar to rotor 102 but having a hub 142 with a larger diameter than the hub 108 and shorter rotor plates 143 than plates 107. The rotor 202 rotates in direction 141 in a similar housing 140. Having the shorter plates 143 and larger hub 142 define a shallower rotor pocket 206 having a smaller volume than pocket 106 of FIG. 10A. With a smaller volume, rotor 202 can be rotated faster, for example, from 10 to 20 rpm, and feed a comparable volume of chips as the slower rotating rotor 102. This ensures a more uniform flow of chips through a metering device having one or more rotors 202 compared to a device having one or more rotors 102.

FIG. 10C illustrates another rotor 302 according to this invention. Rotor 302 has a hub 144 having a smaller diameter than conventional hub 108 and shorter rotor plates 145 than conventional plates 107. Rotor 302 rotates in the direction of arrow 141 in a housing having an internal diameter, shown by circle 140', that is smaller than circle 140 of FIG. 10A. As in FIG. 10B, rotor 302 of FIG. 10C can rotate at a faster speed, for example, 10 to 20 rpm, and transfer as much material as the larger rotor turning a at a slower speed, but transfer the material more uniformly.

FIG. 10D illustrates another rotor 402 according to this invention. Rotor 402 has a hub 147 that may be similar to conventional hub 108, but the radial plates 146 are oriented so that, unlike rotors 102, 202, and 302, they are not parallel to the axis of the rotor. For example, the plates 146 are similar to the plats 207 of FIG. 9*b*. Rotor 402 rotates in the direction of arrow 141 in a housing having an internal diameter, shown by circle 140, which may be similar to circle 140 of FIG. 10A.

Figure 11:
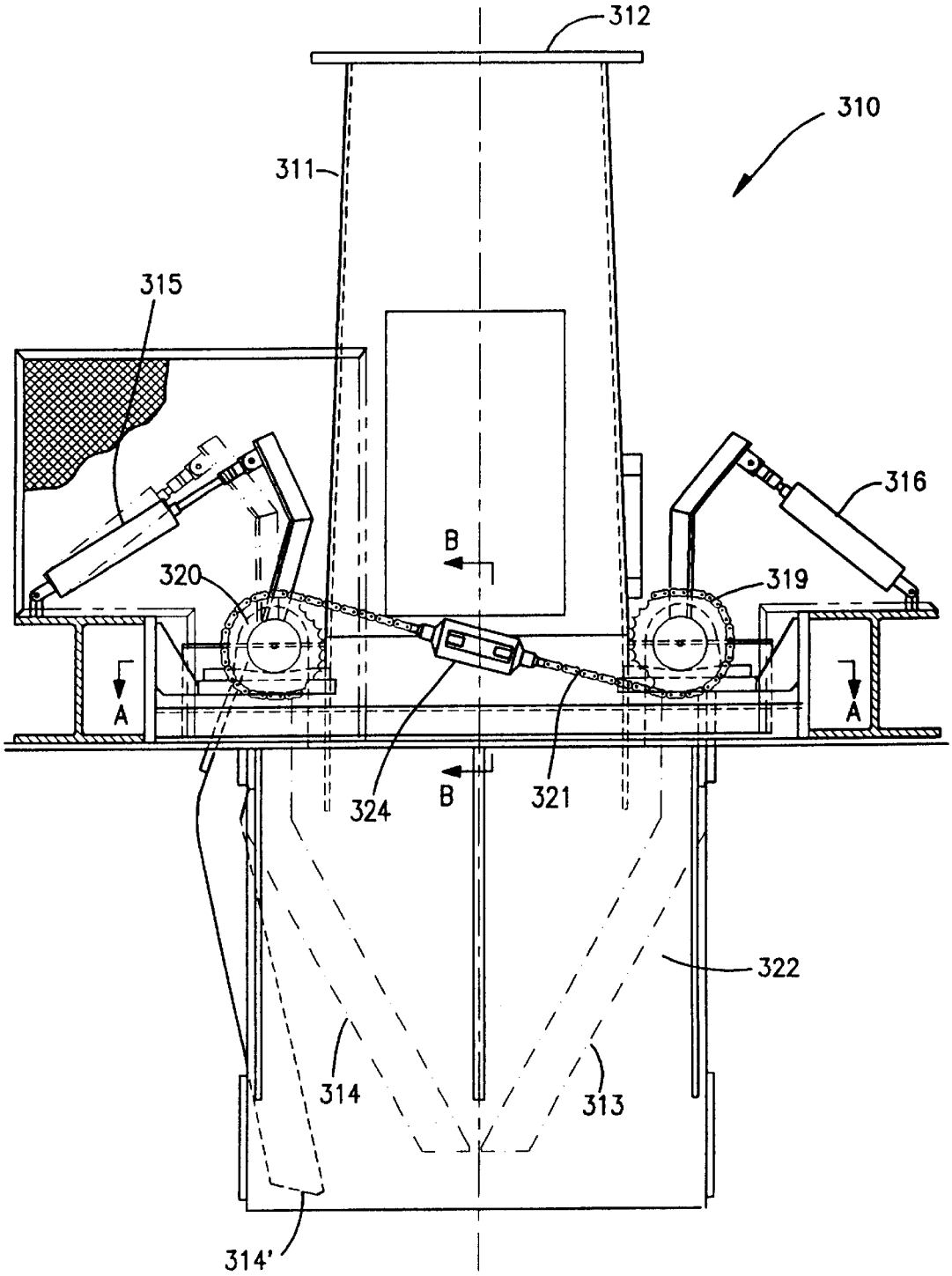
FIGS. 11 and 12 are front and side elevational views of an exemplary device for introducing chips into a bin of the invention.
Figure 12:
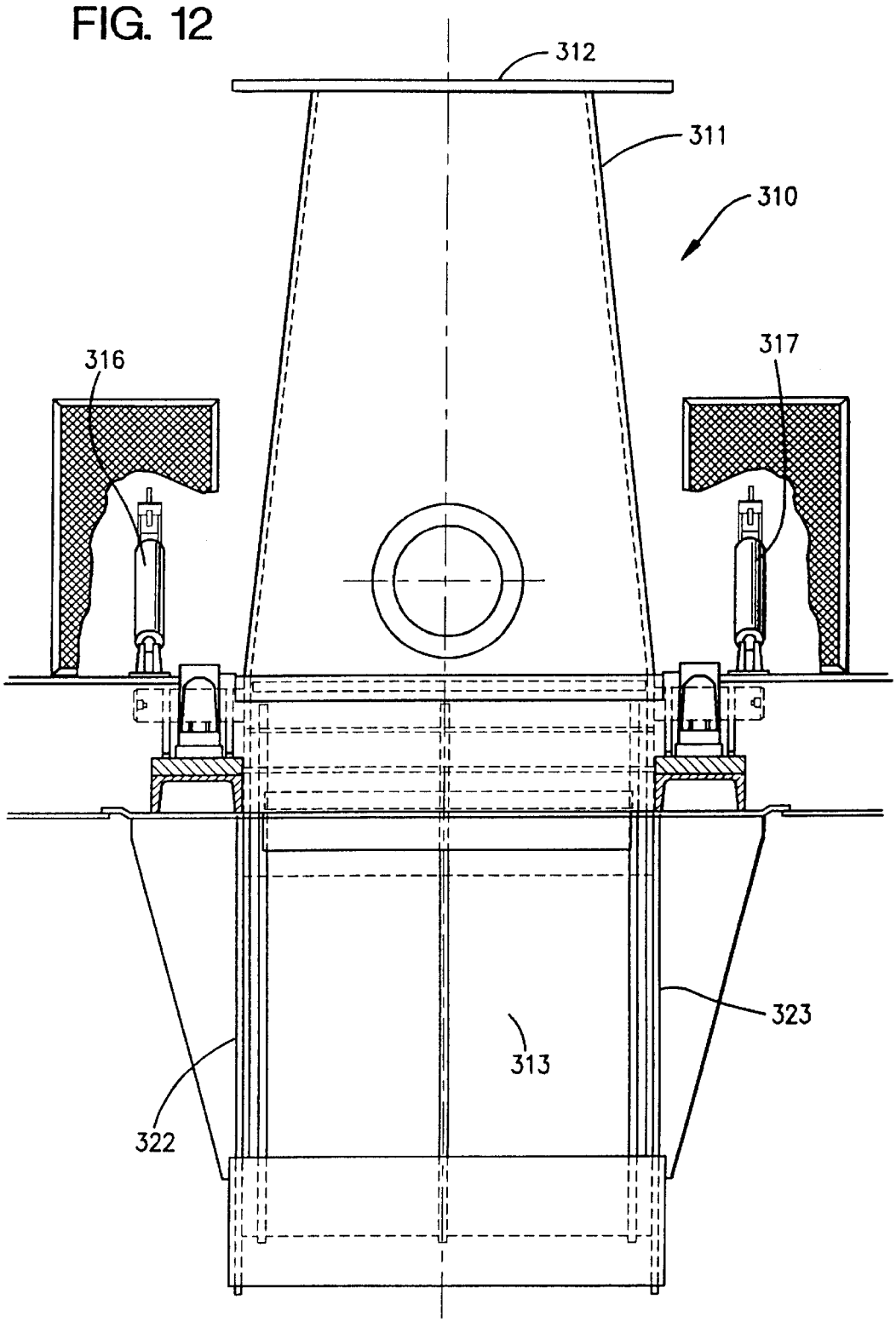

The device 310 of FIGS. 11 and 12 is a small bin and gate arrangement mounted on the top of a chip bin 10 (e.g. in place of 12 in FIG. 1) and is used to introduce chips to the center of the bin 10 with little or no escape of gases. This device can also be used to control the rate of flow of chips based upon varying chip weight. The significant features of this design include:

The sprocket 319, 320, chain 321 and turnbuckle 324 synchronize movement of the two gates;

The set of long, pointed gates 313, 314 that are less susceptible to uneven loading by the incoming chips than conventional shallower gates, for example, as shown in U.S. Pat. No. 4,927,312;

The vertical side plates 322, 323 on either side of the gates provide lateral retention of the chips and also prevent chips from being "pinched" between the gates and side plates. In conventional arrangements, for example, as shown in U.S. Pat. No. 4,927,312, the movable gates butt up against mating side plates when the gates are closed; and Adjustable actuators 315–318, that is, pneumatic, hydraulic, electronic, etc., provide variable resistance to gate deflection and can be used to control the relative deflection of the gates based upon the load of chips above.

Typical operation of system 310 includes chips entering the upper bin 311 at the top inlet 312, for example from a conveyor (not shown), falling through the upper bin 311 and striking the gates 313, 314. The gates 313, 314, remain in a closed position until sufficient chips provide sufficient load to deflect the actuators 315, 316, 317, and 318 and deflect the gates 313, 314 to allow the chips to flow into the bin 10 below. Four actuators are used here, but a single actuator could be used for each gate. The at least one set of sprockets 319, 320 and adjustable chain 321, for example, adjustable by means of turnbuckle 324, ensure that the gates 313, 314 deflect in unison and that the chips fall in the center of the chip bin 10, thus improving chip distribution and loading in the bin. The side plates 322, 323 retain the chips on the deflecting gates. Since these side plates 322, 323 extend beyond the deflection of the gates 313, 314, chips cannot be "pinched" between the gates and the edges of the side plates, which can happen in conventional bins. The resistance of the actuators 315–318, to the deflection of the gates can be varied to ensure a level of chips in the assembly, for example, in the bin 311, to provide a seal against leakage of gases with the bin below. Typically, the gates are operated such that the gates do not completely close, but are operated such that the gates are deflected while a relatively constant level of chips is maintained. That is, unlike what can occur in conventional designs, the gates 313, 314 are not allowed to repeatedly open and close abruptly as the weight or rate of feeding the chips varies, which can both damage the gates and cause undesirable "clanging" during operation.

It will thus be seen that according to the present invention an improved chisel-type discharge for a chip bin or the like has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

In a steaming vessel, or chip bin, either according to the invention, or of conventional construction, alkali may be added to dissolve the resinous materials that can make the chips "sticky" and prone to bridge or channel. For example at one mill where a DIAMONDBACK® steaming vessel/chip bin is installed, the mill is having trouble handling "fresh" wood chips in the bin. It is believed that either the content of resinous material, for example, pitch, is greater in these fresh chips than normal, or the steaming process promotes the extraction of the resinous material from these chips so that the chips are more prone to adhere to each other and thus support the forces that can create bridging in the bin. These resinous materials will dissolve in an alkaline material, such as kraft white liquor, green liquor, black liquor, or other alkaline materials, for example, sodium hydroxide, sodium carbonate, lime, lime mud, or their equivalents or derivatives, all of which already exist in a kraft pulp mill.

The addition of alkaline material, such as white liquor, to a steaming vessel is not novel; however, the present reason for adding alkali to the bin is believed novel. In the past, white liquor has been added to chip steaming vessels in order to control the formation of scale in the vessel and in the downstream vessels or equipment. The use of alkali to dissolve resinous materials that affect, and possibly regulate, the flow characteristics of the chips through the bin, has not heretofore been practiced.

The broadest embodiment of this aspect of the invention is a method for treating chips (comminuted cellulosic fibrous material) containing resinous material in a kraft pulp mill, or the like, using a cylindrical vessel having a bridging or channeling problem as a result of the content or type of resinous material in the chips, comprising the steps of: (a) introducing the material to the vessel; (b) introducing steam to the vessel to heat the material; and (c) introducing an alkaline liquid of the pulp mill (preferably white liquor) to the vessel to dissolve at least some of the resinous material so that the resinous material does not interfere with the flow of the material though the vessel.

What is claimed is:

1. A bin for handling comminuted cellulosic fibrous material comprising:

a hollow substantially right circular cylindrical first, main body portion having a substantially vertical central axis, a top and an open bottom;

a top wall closing off said top of said main body portion, and allowing introduction of particulate material into said hollow main body portion mounted thereon;

a second hollow transition, portion connected to said bottom of said first body portion having a substantially circular cross-section open top and a substantially rectangular cross-section open bottom and a first width dimension, and a larger cross-sectional area at said top thereof than at said bottom thereof, and opposite non-vertical gradually tapering side walls;

at least one metering device mounted below said open bottom of said second transition portion, in a housing;

a third, hollow transition, portion located between said second hollow transition portion and said metering device housing and having a height;

a discharge operatively connected to said metering device housing;

said at least one metering device being operable to move particulate material from said bottom of said third transition portion to said discharge;

wherein the height of said third hollow transition portion is at least equal to said first width dimension of said open bottom of said second hollow transition portion; and one or more baffles provided between the second transition portion and the third transition portion for extending the converging side walls of the second transition portion into the third transition portion, and to provide radial relief for material flowing into said third transition portion.

2. A bin as recited in claim 1 wherein said one or more baffles is or are adjustable to adjust the width of the open bottom of the second transition portion to regulate the flow of material from the second transition portion through the third transition portion to the metering device.

3. A bin as recited in claim 2 wherein two adjustable baffles are provided.

4. A bin as recited in claim 3 wherein said baffles are spaced from each other a different width from one end of said metering device to another, so that the spacing therebetween increases from a point furthest from said discharge to a point adjacent said discharge.

5. A bin as recited in claim 1 wherein said metering device comprises a single variable-pitch metering screw.

6. A bin as recited in claim 1 wherein said metering device comprises at least one metering screw that is disposed at an angle of at least about two degrees sloping downwardly from the horizontal from a position furthest from the discharge to a position closest to the discharge.

7. A bin as recited in claim 1 wherein said metering device comprises a plurality of star-type metering devices.

8. A bin as recited in claim 7 further comprising baffles between said star-type metering devices to direct material into said devices.

9. A bin as recited in claim 1 wherein said third hollow transition portion has a second width dimension greater than said first width dimension.

10. A bin as recited in claim 1 further comprising a device for introducing steam into said first body portion.

11. A method of handling comminuted cellulosic fibrous material utilizing a chisel-type discharge from a comminuted cellulosic fibrous material bin having a first hollow substantially right circular cylindrical first body portion, a second hollow transition portion connected to the bottom of the first portion and having a substantially circular cross-section open top and a substantially rectangular cross-section open bottom and a larger cross-sectional area at the top than at the bottom and opposite non-vertical gradually tapering side walls, and at least one metering device mounted below the open bottom of the second transition portion in a housing; said method comprising the steps of:

(a) feeding comminuted cellulosic fibrous material into the top of the first body portion;

(b) causing the material to flow downwardly through the first portion and into and through the second portion;

(c) causing the material to flow through a third transition portion from the second portion substantially directly to the metering device so that the flow of material from one side to the other is substantially uniform; and (d) discharging the material from the bin using the metering device.

12. A method as recited in claim 11 comprising the further step of steaming the material in the bin.

13. A method as recited in claim 11 comprising the further step (e) of adjusting the size of the opening between the second transition portion and the third transition portion to control the flow rate of material.

14. A method as recited in claim 13 wherein step (e) is practiced in part by providing a difference in the width of the opening from one end of the metering device to the other to provide a larger area adjacent one end of the metering device than the other.

15. A method as recited in claim 11 wherein steps (c) and (d) are practiced so that the third transition is not completely full of comminuted cellulosic fibrous material so as to provide compression relief for the material.

16. A method as recited in claim 15 wherein the second portion has an open bottom with a first width dimension, and wherein the third transition portion has a height; and wherein steps (b) through (d) are practiced so that the height of the third transition portion is at least equal to the first width dimension of the open bottom of the second transition portion.

17. A method as recited in claim 16 comprising the further step (e) of adjusting the size of the opening between the second transition portion and the third transition portion to control the flow rate of material.

18. A vessel for handling comminuted cellulosic fibrous material comprising:

a first hollow top portion;

a second hollow transition portion disposed substantially directly below said first portion, said second transition portion having a larger cross-sectional area at a top portion thereof than at an open bottom portion thereof with a first width, and opposite non-vertical gradually tapering side walls, a third hollow transition portion located substantially directly below said second hollow transition portion;

at least one adjustable baffle operatively disposed between said second and third transition portions to adjust the effective dimension of said first width; and a metering device disposed below said third transition portion for transporting comminuted cellulosic material from said third transition portion to a discharge; and said third transition portion, during operation, not being completely full of comminuted cellulosic material so that compression relief is provided.

19. A vessel as recited in claim 18 wherein said at least one baffle comprises two adjustable baffles that are spaced from each other a different width from one end of said metering device to another, so that the spacing therebetween substantially continuously increases from a point furthest from said discharge to a point adjacent said discharge.

20. A vessel assembly for handling comminuted cellulosic fibrous material comprising:

a substantially hollow chisel-type convergence vessel including a substantially cylindrical main body portion with opposite side walls gradually converging to a substantially rectangular outlet;

a discharge device below said outlet; and means for substantially continuously and uniformly withdrawing material from said outlet with minimal or no lateral or upward thrust on the material above said outlet, and for substantially uniformly and continuously discharging the material from said metering device.

21. A method of treating comminuted cellulosic fibrous material using a vessel having a hollow main body and a chisel-shaped discharge to a substantially rectangular bottom outlet, and a discharge device below the outlet, said method comprising the steps of:

(a) feeding material into the top of the vessel to flow downwardly toward the bottom;

(b) substantially continuously and uniformly withdrawing material from the outlet; and (c) operating the discharge device so that there is substantially no upward thrust on the material above the outlet as a result of the discharge device and so that the discharge of material from the metering device is substantially uniform and continuous.

22. A method as recited in claim 21 wherein steps (a)–(c) are practiced so that the residence time of a volume of material in the vessel does not differ, in a twenty-four hour period, from the residence time of any other volume by more than about four minutes.

23. A method of treating comminuted cellulosic fibrous material using a vessel having a hollow main body and a chisel-shaped discharge to a substantially rectangular bottom outlet, and a discharge device below the outlet, said method comprising the steps of:

(a) feeding material into the top of the vessel to flow downwardly toward the bottom; and (b) substantially continuously and uniformly withdrawing material from the outlet and, discharging the material from the discharge device, so that the residence time of a volume of material in the vessel does not differ, in a twenty-four hour period, from the residence time of any other volume by more than five minutes.

24. A bin for handling comminuted cellulosic fibrous material comprising:

a hollow substantially right circular cylindrical first, main body portion having a substantially vertical central axis, a top and an open bottom;

a top wall closing off said top of said main body portion, and allowing introduction of particulate material into said hollow main body portion mounted thereon;

a second hollow transition, portion connected to said bottom of said first body portion having a substantially circular cross-section open top and a substantially rectangular cross-section open bottom and a first width dimension, and a larger cross-sectional area at said top thereof than at said bottom thereof, and opposite non-vertical gradually tapering side walls;

at least one metering device mounted below said open bottom of said second transition portion, in a housing;

a third, hollow transition, portion located between said second hollow transition portion and said metering device housing and having a height;

a discharge operatively connected to said metering device housing;

said at least one metering device being operable to move particulate material from said bottom of said third transition portion to said discharge;

wherein the height of said third hollow transition portion is at least equal to said first width dimension of said open bottom of said second hollow transition portion; and wherein said metering device comprises at least one metering screw that is disposed at an angle of at least about two degrees sloping downwardly from the horizontal from a position furthest from the discharge to a position closest to the discharge.

25. A bin as recited in claim 24 wherein said angle is 2–15 degrees sloping downwardly from the horizontal.

26. A bin as recited in claim 24 wherein said angle is variable, so that it may be adjusted to a position between about 2–15 degrees from horizontal.

27. A bin for handling comminuted cellulosic fibrous material comprising:

a hollow substantially right circular cylindrical first, main body portion having a substantially vertical central axis, a top and an open bottom;

a top wall closing off said top of said main body portion, and allowing introduction of particulate material into said hollow main body portion mounted thereon;

a second hollow transition, portion connected to said bottom of said first body portion having a substantially circular cross-section open top and a substantially rectangular cross-section open bottom and a first width dimension, and a larger cross-sectional area at said top thereof than at said bottom thereof, and opposite non-vertical gradually tapering side walls;

at least one metering device mounted below said open bottom of said second transition portion, in a housing;

a third, hollow transition, portion located between said second hollow transition portion and said metering device housing and having a height;

a discharge operatively connected to said metering device housing;

said at least one metering device being operable to move particulate material from said bottom of said third transition portion to said discharge;

wherein the height of said third hollow transition portion is at least equal to said first width dimension of said open bottom of said second hollow transition portion; and wherein said third hollow transition portion has a second width dimension greater than said first with dimension.

28. A bin as recited in claim 27 further comprising one or more baffles provided between the second transition portion and the third transition portion for extending the converging side walls of the second transition portion into the third transition portion, and to provide radial relief for material flowing into said third transition portion.

29. A bin as recited in claim 28 wherein said one or more baffles is or are adjustable to adjust the width of the open bottom of the second transition portion to regulate the flow of material from the second transition portion through the third transition portion to the metering device.

30. A bin as recited in claim 29 wherein two adjustable baffles are provided.

31. A bin as recited in claim 30 wherein said baffles are spaced from each other a different width from one end of said metering device to another, so that the spacing therebetween increases from a point furthest from said discharge to a point adjacent said discharge.

32. A bin as recited in claim 27 wherein said metering device comprises a single variable-pitch metering screw.

* * * * *